US005810951A

United States Patent [19]

Dorricott

[11] Patent Number: 5,810,951

[45] Date of Patent: Sep. 22, 1998

[54] STECKEL MILL/ON-LINE ACCELERATED COOLING COMBINATION

[75] Inventor: Jonathan Dorricott, Davenport, Iowa

[73] Assignee: IPSCO Enterprises Inc., Wilmington, Del.

[21] Appl. No.: 594,704

[22] Filed: Jan. 31, 1996

Related U.S. Application Data

[63] Continuation-in-part of Ser. No. 479,656, Jun. 7, 1995, abandoned.

[51] Int. Cl.[6] ..... C21D 8/02

[52] U.S. Cl. ..... 148/654; 72/229; 72/201

[58] Field of Search ..... 72/229, 201; 266/103, 266/113; 148/654

[56] References Cited

U.S. PATENT DOCUMENTS

| | | | |
|---|---|---|---|
| 4,658,363 | 4/1987 | Tippins et al. . | |
| 5,276,952 | 1/1994 | Thomas et al. | 72/229 |
| 5,414,923 | 5/1995 | Thomas et al. | 72/229 |

FOREIGN PATENT DOCUMENTS

| | | | |
|---|---|---|---|
| 0 099 520 A | 2/1983 | European Pat. Off. . | |
| 0 123 406 A | 10/1984 | European Pat. Off. . | |
| 0 177 187 A | 4/1986 | European Pat. Off. . | |
| 0 666 332 A | 8/1995 | European Pat. Off. . | |
| 62-174323 | 7/1987 | Japan | 148/654 |
| 62-196325 | 8/1987 | Japan | 148/654 |
| 2 001 673 | 2/1979 | United Kingdom . | |
| 2 134 022 | 8/1984 | United Kingdom . | |
| WO86 01231 A | 2/1986 | WIPO . | |
| 092021454 | 12/1992 | WIPO | 72/229 |

OTHER PUBLICATIONS

The Making, Shaping and Treating of Steel, 10th Edition, 1985, published by the Association of Iron & Steel Engineers, Chapter 41, Section 8, pp. 782–785.

On the Fundamentals of HSLA Steels, Cohen and Hansen, HSLA Steels Metallurgical Applications, Proceedings and Conference, Bejing, China, 1985, pp. 61–70.

Intensive Cooling: 3.7m Heavy Plate Mill, Thyssen Stahl AG, Duisburg–Süd/B.R. Deutschland.

*Primary Examiner*—Deborah Yee

*Attorney, Agent, or Firm*—Robert H. Barrigar; Barrigar & Moss

[57] ABSTRACT

The in-line combination of a reversing rolling mill (Steckel mill) and its coiler furnaces with accelerated controlled cooling apparatus immediately downstream thereof and associated method permits steel to be sequentially reversingly rolled to achieve an overall reduction of at least about 3:1, imparted by a first reduction while the steel is kept at a temperature above the $T_{nr}$ by the coiler furnaces so as to preserve an optimum opportunity for controlled recrystallization of the steel after each rolling pass, and a second reduction while the temperature of the steel drops from about the $T_{nr}$ to about the $Ar_3$. The second reduction is preferably of the order of 2:1 as a result of which the steel reaches a final plate thickness. The steel product then passes through the accelerated controlled cooling apparatus, preferably applying laminar flow cooling at least to the upper surface of the steel passing therethrough so as to reduce the temperature of the steel from about the $Ar_3$ to a temperature at least about 250 C. to about 300 C. or more below the $Ar_3$ at a cooling rate of at about 12 C. to about 20 C. and preferably about 15 C. per second, thereby to achieve a preferred fine-grained predominantly bainite structure affording enhanced strength and toughness in the final steel product.

15 Claims, 3 Drawing Sheets

STECKEL MILL/ON-LINE ACCELERATED COOLING COMBINATION

RELATED APPLICATION

This application is a continuation-in-part of U.S. application Ser. No. 08/479,656 filed on 7 Jun., 1995, now abandoned.

FIELD OF INVENTION

This invention relates to the in-line combination of a reversing roll mill (herein referred to as a Steckel mill) and its associated coiler furnaces with accelerated cooling apparatus downstream of the Steckel mill, and a preferred method of operating same. This combination of equipment and the method of operating same would find their utility as part of a hot steel rolling mill or preferred method of operating same.

BACKGROUND OF THE INVENTION

In an as-hot rolled microalloyed steel, optimum strength and toughness are conferred by a fine grained polygonal ferrite structure. Additional strengthening is available via precipitation hardening and ferrite work hardening, although these can be detrimental to the fracture properties. The development of a suitable fine grained structure by thermo-mechanical processing or working such as hot rolling, can be considered to occur in three or rarely four stages or regions. In the first, a fine grained structure is produced by repeated austenite recrystallization at high temperatures. This is followed, in the second, by austenite pancaking at intermediate temperatures. The third stage involves the still lower temperatures of the intercritical region, i.e. the ferrite/austenite two-phase range. Rarely, further working below the ferrite/austenite two-phase temperature range can occur. For a given chemistry (alloy composition), the final microstructure is dictated by the amounts of strain applied in each of these temperature ranges.

The first stage occurs at temperatures above a critical temperature $T_{nr}$, being the temperature below which there is little or no austenite recrystallization. The second stage occurs at temperatures below temperature $T_{nr}$ but above another critical temperature $Ar_3$, being the upper temperature limit below which austenite begins to transform into ferrite. The third stage occurs at temperatures below temperature $Ar_3$ but above another critical temperature $Ar_1$, being the lower temperature limit below which the austenite-to-polygonal ferrite transformation is complete. The final stage occurs below temperature $Ar_1$ (The designations $Ar_3$ and $Ar_1$ are generally used to identify the upper and lower temperature limit respectively of the ferrite/austenite two-phase region, as it exists during cooling.) Since only limited improvement in steel characteristics normally occurs below temperature $Ar_1$, steel is frequently not rolled below this temperature, although further such rolling would tend to further harden the steel.

An objective for obtaining superior strength and toughness of steel is to obtain as much fine-grained bainite as possible in the final product. To this end, a specific amount of reduction should occur above the minimum recrystallization temperature $T_{nr}$.

In-line accelerated cooling apparatus is well known in steel rolling mill technology. It is found in a number of in-line rolling mills in which steel progresses from a caster through a series of reduction stands and eventually is reduced to a finished product thickness, cut to length and offloaded. At an appropriate stage downstream of the reduction roll stands, accelerated cooling equipment may be provided that imparts to the rolled steel a relatively rapid cooling intended to consolidate the grain structure that has been obtained during the preceding sequence of reductions of the intermediate steel sheet product. The purpose of the accelerated cooling is to cool the rolled intermediate product quickly once it has reached the $Ar_3$, and more importantly, to promote transformation of austenite to bainite, which possesses attractive combinations of strength and toughness.

A problem with this conventional technology is that the steel undergoing the series of reductions is continuously losing heat and dropping in temperature. Because reduction of the steel, while the temperature of the steel remains above the $T_{nr}$ (the temperature above which recrystallization will occur) imparts fine grain structure to the steel and because the sheet is constantly dropping in temperature, it is desirable to run the steel as rapidly as possible through the series of reduction stands in order to optimize the amount of reduction that can occur above the $T_{nr}$. However, such rapid passage of the steel through the series of reduction stands can have at least some undesirable offsetting counter-effects, including:

1. the absence of sufficient time between sequential passes for the desired amount of recrystallization to occur; and
2. the increased capital expenditure required to provide equipment compatible with high-speed rolling mill operation.

Suitable accelerated cooling equipment may comprise water spray devices or laminar flow cooling or a combination of both. While in some situations, an immersion cooling might be appropriate, it is seldom suitable for the capturing of fine-grain bainite that is the objective of the accelerated cooling technology heretofore practised.

SUMMARY OF THE INVENTION

I have discovered that a superior use of accelerated cooling with the objective of obtaining a steel product (coil or plate) characterized by fine grain structure bainite can be obtained by combining accelerated cooling with Steckel mill rolling. Steckel mill rolling is inherently slower than in-line sequence reduction rolling, and this slower rolling procedure permits the recrystallization within the steel undergoing processing to occur optimally, whereas in high-speed in-line sequential rolling stand-type steel mills, there may be insufficient time between sequential reductions for the steel to take full advantage of the recrystallization phenomenon.

The conventional wisdom is that the time between sequential reductions has to be kept short because the steel sheet being rolled is constantly losing temperature. However, in a Steckel mill this problem is not nearly as acute because the Steckel mill is used in conjunction with associated coiler furnaces into which the steel sheet being rolled can be coiled up following each pass of the sheet through the Steckel mill. The coiled steel is retained in the coiler furnace, maintained at a temperature that is typically at least about 1,000 C., a temperature which is above the $T_{nr}$ for most grades of steel of interest. Consequently, an optimum amount of reduction at temperatures above the $T_{nr}$ of the steel sheet can be achieved using the Steckel mill.

Between successive rolling passes, the steel undergoing rolling changes direction, as do the rolls of the Steckel mill and the coilers of the coiler furnaces. Specifically, during one rolling pass, the steel is moved one way by the rolls of the Steckel mill and the coiler furnaces. During the next rolling pass, the steel is moved in the opposite direction by the rolls of the Steckel mill and the coiler furnaces. Between these rolling passes, the steel and the rolls of the Steckel mill must change direction; the coiler furnaces must switch between coiling mode and uncoiling mode. All of these changes take time, especially having regard to the inertia of the masses required to be decelerated to zero and then re-accelerated, contributing to the inherent time delay between successive rolling passes. The time interval between successive rolling passes in any Steckel mill is therefore relatively large when compared to the time between successive rolling passes for in-line reduction rolling.

Once the desired number of reductions have occurred in the Steckel mill above the $T_{nr}$, then a further series of reductions at somewhat reduced temperatures can occur so as to "pancake" the fine austenitic grain structure obtained. Immediately after the pancaking sequence of reductions, which will occur below the $T_{nr}$ but above the $Ar_3$, the steel is passed through accelerated cooling apparatus so as to obtain a relatively rapid reduction in temperature below the $Ar_3$ for the production of a high proportion (typically more than 90%) of optimally conditioned bainite.

According to one aspect of the invention, a Steckel mill and associated upstream and downstream coiler furnaces are combined in-line with accelerated controlled cooling apparatus downstream of the Steckel mill. The coiler furnaces are maintained at a temperature of at least about the $T_{nr}$, so as to maintain the temperature of the steel being rolled above the $T_{nr}$ for a selected number of rolling passes to achieve a first selected reduction of the steel which is preferably at least about 1.5:1. Thereafter, the steel is rolled below the $T_{nr}$ for a further selected number of rolling passes, so as to achieve a selected second reduction of the steel preferably of the order of 2:1. It can be seen that the combined effect of the first and second reductions is, therefore, an overall reduction of at least about 3:1, which is considered to be the appropriate minimum for the obtention of preferred metallurgical results. The second reduction is completed at an exit temperature from the rolling mill of about the $Ar_3$.

The steel, at about the $Ar_3$ temperature, is then subjected in the accelerated controlled cooling apparatus to controlled cooling of about 12 C. to about 20 C. per second, and preferably about 15 C. per second, so as to reduce the temperature of the steel by at least about 200 C. and preferably at least about 250 C. Since the $Ar_3$ for most commercial grades of steel of interest is typically of the order of 800 C. or at least in the range of about 750–800 C., it follows that the exit temperature following the accelerated controlled cooling of the steel product will be no higher than 600 C. and typically no lower than about 450 C., and most probably and preferably in the range of about 470 C. to about 570 C. The temperature drop imparted by the controlled cooling can be more than 250 C. below the $Ar_3$, but should not be more than about 400 C. below the $Ar_3$ and preferably in the range about 250 C. to about 350 C. below the $Ar_3$.

The accelerated controlled cooling apparatus is preferably laminar flow cooling apparatus so far as the upper surface of the steel being processed is concerned; the undersurface of the steel product is preferably cooled by a quasi-laminar spray. The usual spray medium is water, maintained within conventional temperature ranges.

The amount of the temperature drop from the $Ar_3$ imparted by the accelerated controlled cooling will depend upon the chemistry (alloy composition) of the steel being rolled, in the discretion of the metallurgist who is responsible for the steel processing.

Fine-grain structure in steel is encouraged and enhanced by the presence of columbium (niobium) in the steel alloy composition. With the use of the Steckel mill/accelerated cooling combination and method of the present invention, it should be possible to reduce the amount of columbium in the steel alloy composition and still achieve elements that may possibly be reduced in quantity with the assistance of the present invention are molybdenum and manganese.

THE DRAWINGS

DETAILED DESCRIPTION WITH REFERENCE TO ACCOMPANYING DRAWINGS

Figure 1:
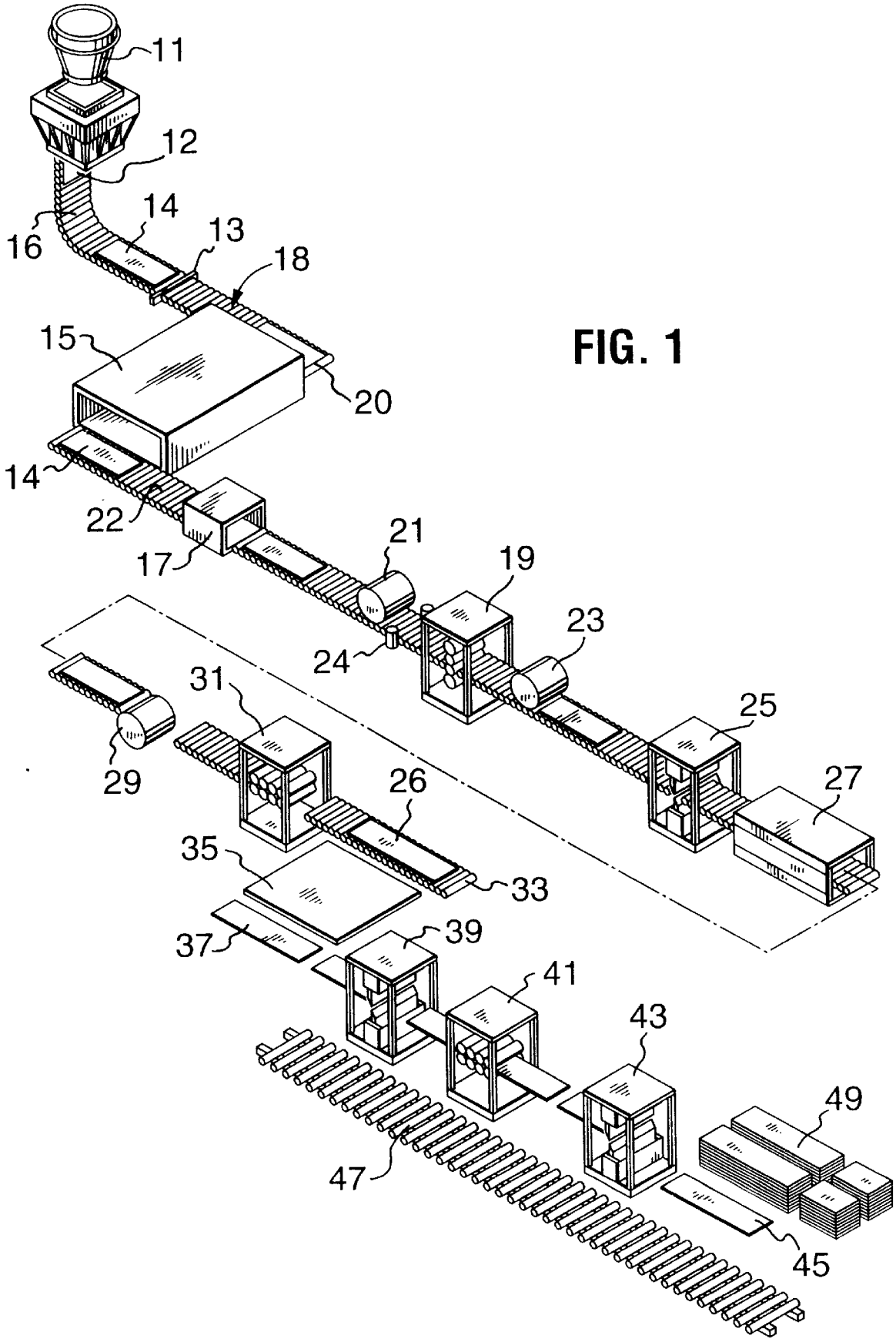
FIG. 1 is a schematic diagram of a steel rolling mill incorporating a Steckel mill and on-line accelerated cooling apparatus in accordance with the principles of the present invention.

Referring to FIG. 1, molten steel is supplied to a caster 11 that produces a cast steel strand 12 that is cut to length by a torch 13 located at the exit of the cast strand containment and redirection station 16 thereby to produce a series of cast slabs 14.

At the terminating end of the caster runout table 18 is a transfer table 20 that transversely feeds the slabs 14 sequentially into reheat furnace 15 where they are brought up to a uniform temperature for rolling. At the exit of reheat furnace 15, the slabs 14 are transferred to the upstream end of a rolling table 22. The slabs are descaled in a descaler 17 and then reversibly rolled in a Steckel mill 19 provided with the usual upstream and downstream coiler furnaces 21, 23. An edger 24 squeezes the side edges of the intermediate rolled product for dimensional control.

Once the intermediate rolled product has reached an appropriate thickness, its leading and trailing ends are cut off by hot flying shear 25 and the product either downcoiled on a downcoiler 29 (if the end-product is strip) or passed further downstream for further processing as an eventual plate product. This invention is concerned with the latter.

The downstream processing may include optional hot-levelling in hot leveller 31 of the intermediate plate product 26 which then passes to a transfer table 33 and thence transversely to a cooling bed 35.

At the exit end of the cooling bed 35, heavier intermediate plate product passes from a transfer table 37 thence to a static shear 39, where it is cut to length. The intermediate product passes thence to a cold-leveller station 41 for further levelling. Lighter product is finally cut to length and/or trimmed by a flying shear 43. The plate end-product 45 may be passed to transfer tables 47 for shipment or piled in piles 49.

In accordance with the invention, on-line accelerated cooling is provided by an on-line accelerated cooling station 27 downstream of hot flying shear 25 that is in turn downstream of the Steckel mill 19. The arrangement is shown in greater detail in FIG. 2, which illustrates the downstream coiler furnace 23 but omits the upstream coiler furnace 21 for space-saving reasons.

It can be seen that the on-line accelerated cooling station 27 includes an upper array 51 of laminar flow cooling devices that provide cooling water to the upper surface of the intermediate steel product 61 passing underneath the upper array 51. At the same time, a lower array 53 of spray cooling devices provide a cooling spray to the undersurface of the intermediate steel product 61 passing above the array 53.

Figure 3:
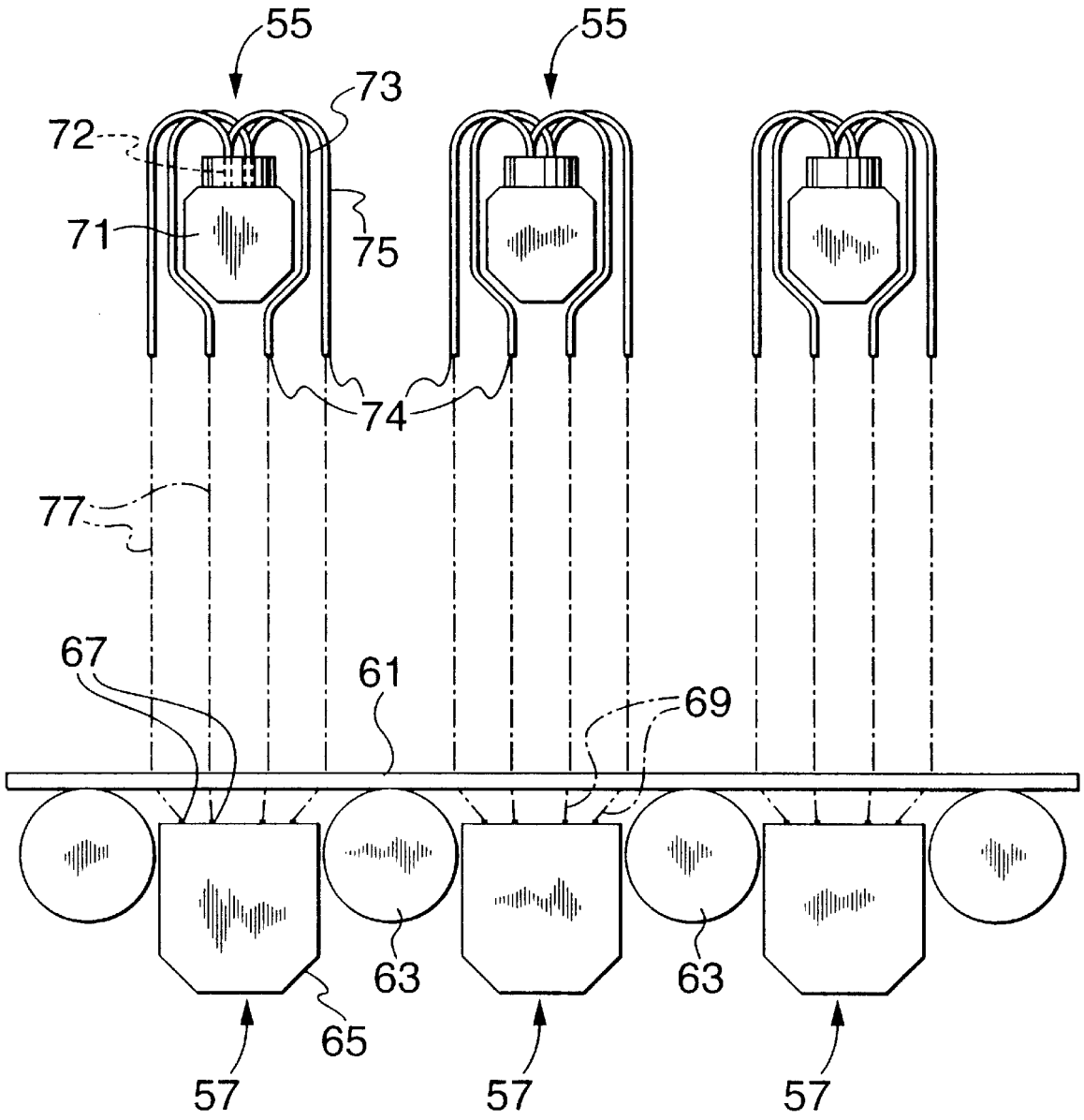
FIG. 3 is a schematic diagram of a portion of the on-line accelerated cooling apparatus of FIG. 2 showing the cooling spray devices and nozzles in greater detail.

The upper array 51 comprises a longitudinally arranged series of cooling nozzle groups or banks 55 that are more clearly presented in FIG. 3. It can be seen that each individual transversely arrayed bank is supplied by a transverse water supply header 71 providing water to a transversely spaced series of inner laminar flow nozzle elements 73 and outer laminar flow nozzle elements 75. It can be seen from FIG. 3 that these nozzle elements 73, 75 are connected at their inner ends 72 to the water supply header 71 from which they obtain a continuous supply of water. The water flows in a series of four laminar rows 77 from each laminar flow bank 55, the rows of water 77 flowing out of the open-end 74 of the nozzle 73, 75 and onto the upper surface of the intermediate steel product 61 passing underneath the laminar flow nozzle banks 55.

On the underside of the intermediate steel product 61, cooling water sprays 69 are ejected from outlet ports or nozzles 67 both longitudinally and transversely spaced along the upper surfaces of spray headers 57 that supply the nozzles 67. The headers 57 are themselves longitudinally spaced from one another and interposed between a longitudinal series of transversely extending table rolls 63 that support and drive the intermediate steel product 61. The nozzles 67 are preferably arranged to provide quasi-laminar cooling. They may be, for example, of the design of the Mannesmann DeMag accelerated controlled cooling facility installed in or about 1990 at the Rautaruukki Steel Mill in Finland.

Figure 2:
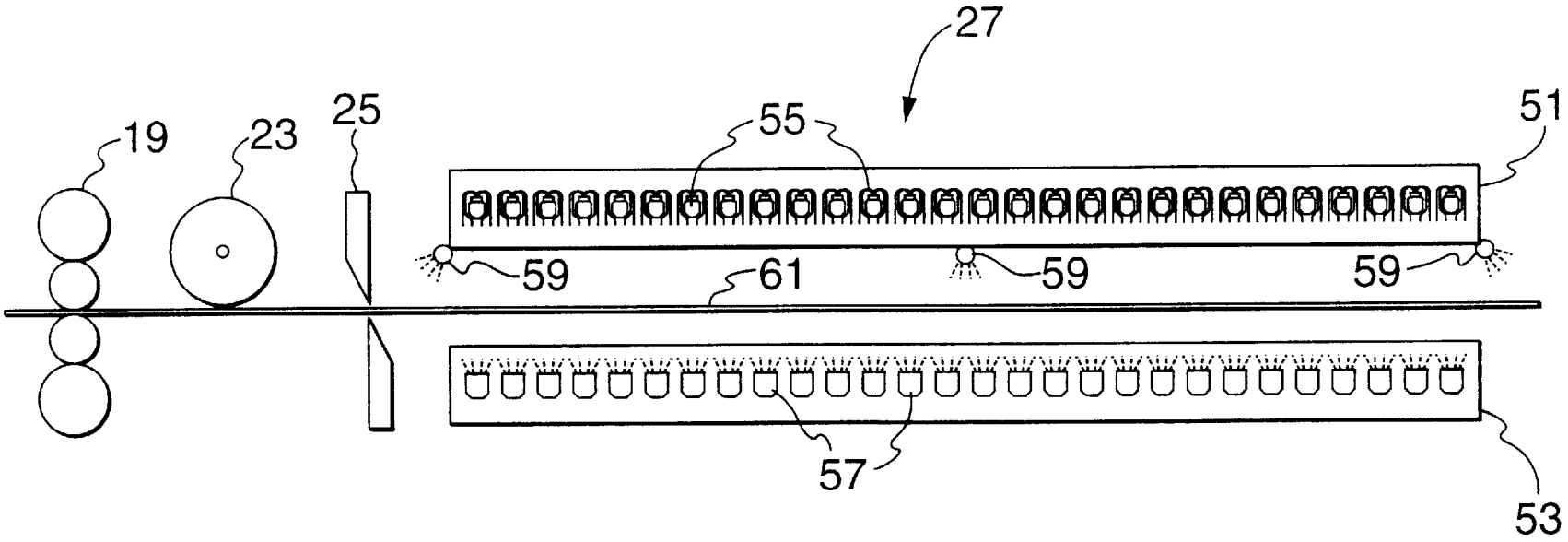
FIG. 2 is a schematic diagram of the Steckel mill, shear and on-line accelerated cooling apparatus of FIG. 1 showing the on-line accelerated cooling apparatus in greater detail.

Although the accelerated controlled cooling apparatus is illustrated in FIG. 2 as constituting a single extended array of cooling nozzles, it may be desirable to divide the accelerated controlled cooling apparatus longitudinally into a series of separated banks, each bank being individually selectably operable to provide cooling water or to be shut off. Such latter arrangement would facilitate a controlled reduction in the amount of water applied to the rolling of thinner steel products which, in turn, would facilitate the maintaining of the rate of cooling at about the 15 C.-per-second preferred cooling rate.

Wipe nozzles 59 of conventional design remove surplus water from the upper surface of the intermediate steel product 61.

In accordance with the invention, Steckel mill 19 is used in conjunction with its associated coiler furnaces 21, 23 to maintain the intermediate steel product undergoing processing at an adequately high rolling temperature. As is well understood, in the reversing rolling sequence through the Steckel mill 19, once the slab 14 being rolled has reached a suitably small thickness (say of the order of 1") it may be coiled within the coiler furnaces 21, 23 following alternate passes through the Steckel mill. Since the coiler furnaces 21, 23 are maintained at an adequately high internal temperature (say about 1,000 C. or above), the steel being rolled may be maintained for as many passes as the mill operator wishes at a temperature of at least about 1,000 C., which is, for steel grades of interest, above the $T_{nr}$. The slab is rolled above the $T_{nr}$ so as to reduce its thickness to a desired target thickness, say one-third of the initial slab thickness. Because the steel is being rolled above the $T_{nr}$, there is ample opportunity for the steel between passes to undergo recrystallization between passes; the slower speed of a Steckel mill relative to sequential in-line rolling stands facilitates the recrystallization by affording the steel time to take optimum advantage of the recrystallization phenomenon between sequential reductions. This rolling sequence above the $T_{nr}$ will achieve a fine-grained austenite structure of the steel undergoing sequential reductions.

Once the steel has reached a target thickness above the $T_{nr}$, its temperature is then permitted to drop in a controlled manner through a further series of sequential reversing passes through the Steckel mill during which the fine grain structure achieved is "pancaked" and consolidated. Over the period of time taken by a predetermined series of passes below the $T_{nr}$, the temperature may be permitted to drop from the $T_{nr}$ to the $Ar_3$ at which time the intermediate steel product should have reached its target end thickness. Although a reduction of as much as 75% between the $T_{nr}$ and the $Ar_3$ can be tolerated, it is preferred that the end thickness be about one-half the thickness of the intermediate steel product at the time it begins to drop below the $T_{nr}$. In other words, the "pancaking" rolling between the $T_{nr}$ and the $Ar_3$ would preferably result in a 2:1 reduction from the thickness of the intermediate steel product to the final product thickness.

Preferred metallurgical practice dictates that the overall reduction in the rolling mill should be at least about 3:1. Accordingly, if the reduction imparted below the $T_{nr}$ is about 2:1, then it follows that the reduction above the $T_{nr}$ should be at least about 1.5:1. The amount of reduction, of course, will depend in large measure upon the ratio of the end-product thickness (determined by the customer's order) and the initial slab thickness (typically fixed for a given rolling mill). If, for example, the end-product thickness is to be 1", then preferably the intermediate steel product is rolled from a thickness of about 2" to a thickness of 1" below the $T_{nr}$ to reach a rolling completion temperature of about the $Ar_3$. If the initial slab thickness is 6", it follows that a 3:1 reduction must occur above the $T_{nr}$ in order to generate an intermediate product of 2" that can be rolled between the $T_{nr}$ and the $Ar_3$ to the desired 1" end-product thickness.

After rolling, the steel is passed through the on-line accelerated cooling station with an entry temperature at about the $Ar_3$ and with an exit temperature substantially below that—a temperature drop of at least about 250 C. should preferably occur, with a cooling rate of about 12–20 C. and preferably of the order of about 15 C. per second, depending upon the thickness of the final plate product.

Note in this connection that there is a trade-off between optimum steel conditioning in the accelerated cooling station and optimum conditioning in the hot levelling station. For optimum hot-levelling, the entry temperature of the steel plate is preferably closer to the $Ar_3$ than is desirable for the exit temperature of the plate as it leaves the accelerated cooling station. So the on-line accelerated cooling treatment may be selected to be something less than optimum, leaving the steel plate at a higher than optimum exit temperature as it leaves the accelerated cooling station, or else the plate may be given closer to optimum treatment at the accelerated cooling station in which case its entry temperature at the hot-leveller will be lower than would be optimum for the hot-levelling treatment. The trade-off in any given production situation will depend upon the order book and the customer's requirements for the steel product being produced.

If the combination of Steckel mill processing and accelerated cooling is practised as proposed herein, then the amount of columbium (niobium) used to promote preferred fine grain structure could be reduced in comparison with what is normally expected using conventional processing of similar grades of steel. The extent of the possible or preferred reduction in columbium again will depend upon the customer's steel specifications.

The amounts required of other alloying elements such as molybdenum and manganese frequently found in higher grade steel may possibly also be decreased in accordance with the present invention by reason of the obtention of a high-strength steel product without the need for relatively high quantities of alloying elements such as the foregoing.

By proceeding in accordance with the foregoing reversing rolling in the Steckel mill and accelerated controlled cooling thereafter, the transformation of fine grained austenite to fine grained bainite is optimized, with consequent improvement in the metallurgical properties of the steel being produced. The result can be an enhanced combination of strength and toughness.

EXAMPLE

An exemplary application of the invention to prepare ¾" 80,000 PSI yield-strength steel plate begins with a 6" slab of the following chemistry:

| | |
|---|---|
| carbon | 0.03 to 0.05% |
| manganese | 1.40 to 1.60% |
| sulphur | 0.005% max |
| phosphorus | 0.015% max |
| silicon | 0.20 to 0.25% |
| copper | 0.45% max |
| chromium | 0.12% max |
| columbium (niobium) | 0.02 to 0.06% |
| molybdenum | 0.18 to 0.22% |
| tin | 0.03% |
| aluminum | 0.02 to 0.04% |
| titanium | 0.018 to 0.020% |
| nitrogen | 0.010% max |
| vanadium | up to 0.08% |

After casting, the slab is sent to a reheat furnace with an entry temperature of about 800 C. or slightly below and with an exit temperature preferably about 1,260 C.

The slab is then sent to the Steckel mill for reverse rolling according to the following rolling schedule:

| | Temperature | Thickness |
|---|---|---|
| Slab Dropout | 1,260 C. | 6" (152.4 mm) |
| | 1,065 C. | 3" (76.2 mm) |
| | 1,050 C. | 2.18" (55.4 mm) |
| | 1,025 C. | 2.0" (50.8 mm) |
| $T_{nr}$ (Non-Recrys.) | 970 C. | 1.5" (38 mm) |
| | 940 C. | 1.18" (30 mm) |
| | 910 C. | 1.00" (25.4 mm) |
| | 870 C. | 0.88" (22.4 mm) |
| | 815 C. | 0.80" (20.3 mm) |
| $Ar_3$ (Upper Critical) | 800 C. | 0.75" (19 mm) |

In the above table, for steel of the chemistry indicated, the $T_{nr}$ is approximately 970 C. Consequently, it can be seen that the slab has been reduced in thickness according to the above rolling schedule from the reheat furnace dropout temperature of 1,260 C. to a rolling pass at which the temperature remains at the $T_{nr}$ or above (in this example, 970 C.) and over this sequence of rolling passes, the thickness of the slab has been reduced from an initial 6" thickness to 1.5", i.e. a 4:1 reduction.

During this first series of passes, the coiler furnace is maintained at an interior furnace temperature of at least 1,000 C. to prevent the steel being rolled from dropping in temperature below the $T_{nr}$.

Once the intermediate steel product has reached the $T_{nr}$, it is then rolled over the next following rolling sequence down to the $Ar_3$, in the above example, 800 C. During this sequence of rolling passes, the intermediate thickness of 1.5" at about the $T_{nr}$, which should still be effective for achieving some degree of recrystallization, is successively reduced. Note that rolling below the $T_{nr}$ will not admit of any further recrystallization, but instead the next rolling sequence pancakes or flattens the crystal structure previously obtained. In this example, the initial 1.5" thickness obtained from rolling at the $T_{nr}$ is reduced by 50% to an end-product thickness 0.75" at the $Ar_3$. This 2:1 reduction in thickness from the $T_{nr}$ thickness to the $Ar_3$ thickness is representative, and tends to generate a preferred degree of pancaking of the fine crystal structure that had been obtained in the austenite (that is, in accordance with the procedure described, transformed predominantly into bainite).

To optimize the obtaining of fine-grained bainite, the 0.75" intermediate product at an entry temperature of 800 C. (the $Ar_3$) is immediately subjected to on-line accelerated cooling in apparatus of the sort described above. The cooling rate should be approximately 15 C. per second. At the exit of the on-line accelerated cooling station, the plate product may have an exit temperature of approximately 450 C. As explained previously, a trade-off has to be made in selecting the exit temperature as between preferred accelerated cooling, on the one hand, and preferred hot-levelling on the other hand. Some variability in the exit temperature of the plate as it exits the on-line accelerated cooling station may be made, depending upon the mill operator's opinion of the preferred compromise to be made, given the state of the order book and the customer's specifications.

In the above discussion, the assumption has been made that the $T_{nr}$ and the $Ar_3$ can be accurately determined for a given steel product. However, different and somewhat competing approaches to the determination of these critical temperatures are discussed in the technical literature. Depending upon the equations used, the calculated $Ar_3$ (for example) computed according to a given method may differ by as much as about 10 C. from the calculation of the $Ar_3$ using one of the competing methods of calculation. The present invention is not predicated upon any particular selection of method of calculation of the $T_{nr}$ or $Ar_3$. A 10 variation at either end of a stated range of temperatures is equally considered not to be material to the practice of the present invention. In any given plant, the metallurgist or the person responsible for mill operation will undoubtedly evaluate rolling and cooling results empirically, and choose a combination of rolling and cooling parameters that appears to give optimum or near-optimum results. However, optimum or near-optimum results should be obtainable with a minimum of empirical adjustment using the combination and methods described and claimed in the present application.

Variations in what has been described and illustrated in this specification will readily occur to those skilled in the technology. The invention is not to be limited by the specific example and description above; the scope of the invention is as defined in the accompanying claims.

What is claimed is:

1. A method of processing an intermediate steel product to form a final steel plate product, comprising sequentially reversingly rolling a slab of steel over a plurality of rolling passes so as to reduce the thickness of the steel slab by a selected amount while maintaining the temperature of the steel above the $T_{nr}$, during a selected recrystallization period between successive rolling passes, in order to provide controlled recrystallization after each rolling pass, thereby to obtain an intermediate steel product;

continuing the sequential reverse rolling of the intermediate steel product thus obtained while the steel is undergoing a declining temperature from about the $T_{nr}$ to about the $Ar_3$ to obtain a second selected amount of reduction therein, thereby to reach substantially the end-product thickness of the steel, and then subjecting the steel to accelerated on-line cooling so as to reduce the temperature of the steel at a rate in the range of about 12° C. to about 20° C. per second to reach a temperature of at least about 200° C. to about 350° C. below the $Ar_3$, thereby to obtain a steel product of enhanced strength and toughness, having a composition including a substantial portion of fine-grained bainite.

2. A method as defined in claim 1, wherein the on-line cooling reduces the temperature of the steel at a rate of about 15 C. per second to a temperature at least about 250 C. below the $Ar_3$.

3. A method as defined in claim 2, wherein the second selected reduction is at least about 1.5:1.

4. A method as defined in claim 3, wherein the first selected reduction is at least about 1.5:1 and the overall combined first and second reductions are at least about 3:1.

5. A method as defined in claim 4, wherein the first selected reduction achieves fine-grained austenite, the second selected reduction achieves a pancaked austenite; and the accelerated controlled cooling progressively transforms most of the austenite into fine-grained bainite in the end-product.

6. A method as defined in claim 5, including winding the steel within a coiler furnace for said selected recrystallization period following selected rolling passes of the reversing rolling sequence, and maintaining the temperature of the interior of the coiler furnace during such passes at about at least the $T_{nr}$.

7. A method of processing an intermediate steel product to form a final steel plate product comprising sequentially reversingly rolling a slab of steel over a plurality of rolling passes so as to reduce the thickness of the steel slab by a selected amount while maintaining the temperature of the steel above the $T_{nr}$, during a selected recrystallization period between successive rolling passes, in order to provide controlled recrystallization after each rolling pass, thereby to obtain an intermediate steel product; continuing the sequential reversing rolling of the intermediate steel product thus obtained while the steel is undergoing a declining temperature from about the $T_{nr}$ to about the $Ar_3$ to obtain a second selected amount of reduction therein thereby to reach substantially the end-product thickness of the steel and then subjecting the steel to accelerated on-line cooling at a cooling rate within the range of about 12° C. to about 20° C. per second to reach an exit temperature within the range about 470° C. to about 570° C., thereby to obtain a steel product of enhanced strength and toughness and having a preferred structure including a substantial portion of fine-grained bainite structure.

8. A method as defined in claim 7, wherein the cooling rate is about 15 C. per second.

9. A method as defined in claim 8, wherein the second selected reduction is of the order of 2:1.

10. A method as defined in claim 9, wherein the first selected reduction is at least about 2:1.

11. A method as defined in claim 10, wherein the cooling applied to the upper surface of the steel being processed is laminar flow cooling.

12. A method as defined in claim 11, including winding the steel within a coiler furnace for said selected recrystallization period following selected rolling passes of the reversing rolling sequence, and maintaining the temperature of the interior of the coiler furnace during such passes at least at about the $T_{nr}$.

13. A method as defined in claim 12, wherein the first selected reduction achieves fine-grained austenite, the second selected reduction achieves a pancaked austenite; and the accelerated controlled cooling progressively transforms most of the austenite into fine-grained bainite in the end-product.

14. A method as defined in claim 13, where the second reduction is about 2:1.

15. A method as defined in claim 6, where the second reduction is about 2:1.

* * * * *

UNITED STATES PATENT AND TRADEMARK OFFICE

CERTIFICATE OF CORRECTION

PATENT NO. : 5,810,951

DATED : September 22, 1998

INVENTOR(S) : Jonathan Dorricott

It is certified that error appears in the above-identified patent and that said Letters Patent is hereby corrected as shown below:

Col. 4, line 6, change "elements" to --a satisfactory fine-grained structure. Other alloying elements--;

Col. 8, line 45, change "A 10" to --A 10 C.--;

Col. 10, line 16, change "preferred structure" to --composition--.

Signed and Sealed this

First Day of June, 1999

*Attest:*

*Attesting Officer*

Q. TODD DICKINSON

*Acting Commissioner of Patents and Trademarks*